US011866212B2

(12) United States Patent
Williams et al.

(10) Patent No.: US 11,866,212 B2
(45) Date of Patent: Jan. 9, 2024

(54) BAGGING MACHINE AND METHOD

(71) Applicant: Pregis Sharp Systems, LLC, Sussex, WI (US)

(72) Inventors: Jeramy Williams, Helenville, WI (US); Daniel J. Folger, Oconomowoc, WI (US)

(73) Assignee: Pregis Sharp Systems, LLC, Sussex, WI (US)

( * ) Notice: Subject to any disclaimer, the term of this patent is extended or adjusted under 35 U.S.C. 154(b) by 0 days.

(21) Appl. No.: 17/379,755

(22) Filed: Jul. 19, 2021

(65) Prior Publication Data

US 2022/0009662 A1 Jan. 13, 2022

Related U.S. Application Data

(62) Division of application No. 15/318,708, filed as application No. PCT/US2015/036418 on Jun. 18, 2015, now Pat. No. 11,066,202.

(Continued)

(51) Int. Cl.
*B65B 43/12* (2006.01)
*B65B 43/30* (2006.01)

(Continued)

(52) U.S. Cl.
CPC ..... *B65B 43/123* (2013.01); *B65B 7/02* (2013.01); *B65B 43/267* (2013.01); *B65B 43/30* (2013.01);

(Continued)

(58) Field of Classification Search
CPC ..... B65B 43/126; B65B 43/267; B65B 43/30; B65B 51/26; B65B 7/02; B65B 61/06;

(Continued)

(56) References Cited

U.S. PATENT DOCUMENTS 3,543,466 A * 12/1970 Forsberg ..... B65B 1/02 53/481
3,682,051 A * 8/1972 Sengewald ..... B65D 33/002 206/390

(Continued)

FOREIGN PATENT DOCUMENTS

CN 102470988 A 5/2012
EP 0564288 A2 10/1993

(Continued)

*Primary Examiner* — Thomas M Wittenschlaeger
*Assistant Examiner* — Katie L Gerth
(74) *Attorney, Agent, or Firm* — Fox Rothschild LLP

(57) ABSTRACT

A product bagging assembly and method of manipulating a web material bag that is operable to create a bag opening that is greater than six inches and which is operable without substantially detracting from product throughput associated with use and operation of the product bagging assembly. In a preferred embodiment, the bag opening/dosing assembly includes a first actuator and a second actuator that are connected to one another such that a position of one of the actuators can be manipulated by operation of the other actuator. The product bagging assembly can be provided as a kit configured for plug and play operation with previously provided bag and product delivery systems.

19 Claims, 11 Drawing Sheets

Related U.S. Application Data

(60) Provisional application No. 62/013,600, filed on Jun. 18, 2014.

(51) Int. Cl.

| | |
|---|---|
| ***B65B 61/02*** | (2006.01) |
| ***B65B 43/26*** | (2006.01) |
| ***B65B 51/14*** | (2006.01) |
| ***B65B 67/02*** | (2006.01) |
| ***B65B 61/12*** | (2006.01) |
| ***B65B 43/34*** | (2006.01) |
| ***B65B 59/02*** | (2006.01) |
| ***B65B 59/00*** | (2006.01) |
| ***B65B 7/02*** | (2006.01) |
| ***B65B 51/26*** | (2006.01) |
| ***B65B 61/06*** | (2006.01) |

(52) U.S. Cl.
CPC ..... *B65B 43/34* (2013.01); *B65B 51/146* (2013.01); *B65B 51/26* (2013.01); *B65B 59/003* (2019.05); *B65B 59/02* (2013.01); *B65B 61/025* (2013.01); *B65B 61/06* (2013.01); *B65B 61/12* (2013.01); *B65B 67/02* (2013.01)

(58) Field of Classification Search
CPC ..... B65B 59/02; B65B 43/34; B65B 51/146; B65B 61/025; B65B 61/12; B65B 67/02; B65B 43/00; B65B 43/123; B65B 43/26
USPC ..... 53/459, 284.7, 384.1, 386.1
See application file for complete search history.

(56) References Cited

U.S. PATENT DOCUMENTS 3,842,569 A * 10/1974 McClelland ..... B65B 25/04 53/469
3,908,335 A * 9/1975 Giannelli ..... B65B 1/02 53/138.4
4,027,461 A * 6/1977 Jelling ..... B65B 67/04 53/241
4,132,049 A * 1/1979 Mullins, Jr. ..... G07F 11/44 53/384.1
4,172,349 A * 10/1979 Lipes ..... B65B 43/28 53/385.1
4,320,615 A * 3/1982 Gmur ..... B65B 43/18 53/67
4,450,180 A * 5/1984 Watkins ..... B65D 81/34 229/87.08
4,651,506 A * 3/1987 Lerner ..... B65B 43/123 53/469
4,700,755 A * 10/1987 Banys ..... B65B 43/28 53/384.1
4,736,572 A * 4/1988 Fang ..... B29C 66/43121 53/512
4,899,520 A * 2/1990 Lerner ..... B65B 43/12 493/239
4,945,714 A * 8/1990 Bodolay ..... B65B 61/188 53/139.2
4,969,310 A * 11/1990 Lerner ..... B65B 9/08 53/384.1
5,077,958 A * 1/1992 Peppard ..... B65B 43/34 53/375.4
5,177,939 A * 1/1993 Lipes ..... B65B 43/465 53/284.7
5,265,402 A * 11/1993 Lerner ..... B65B 57/06 53/375.2
5,431,087 A * 7/1995 Kambara ..... F15B 15/1428 92/61
5,435,114 A * 7/1995 Moehlenbrock ..... B65B 5/045 53/469
5,442,898 A * 8/1995 Gabree ..... B65B 43/36 53/385.1
5,452,559 A * 9/1995 Lipes ..... B65B 43/465 53/67
5,484,238 A * 1/1996 Bielagus ..... B65B 69/0008 414/412
5,551,215 A * 9/1996 McDonald ..... B65B 43/28 53/570
5,673,541 A * 10/1997 Arzuman ..... B65B 43/465 53/469
5,687,544 A * 11/1997 Watabe ..... B65B 5/022 53/284.7
5,709,069 A * 1/1998 Cronauer ..... B65B 25/002 53/469
5,802,817 A * 9/1998 Hood ..... B65B 43/28 53/469
5,918,441 A * 7/1999 Baker ..... B29C 66/8167 53/374.6
5,970,688 A * 10/1999 Nyiendo ..... B65B 5/045 53/381.6
5,987,854 A * 11/1999 Killinger ..... B65B 43/30 53/386.1
6,134,864 A * 10/2000 McGregor ..... B65B 7/06 53/469
6,279,298 B1 * 8/2001 Thomas ..... B65D 33/2508 53/139.2
6,282,871 B1 * 9/2001 Killinger ..... B65B 43/123 53/469
6,550,226 B1 * 4/2003 Gates ..... B65B 43/36 53/469
6,598,374 B1 * 7/2003 Ensor ..... B65B 39/12 141/114
6,651,546 B2 * 11/2003 Sandlin ..... F15B 7/001 92/52
6,662,532 B1 * 12/2003 Droog ..... B65B 51/18 53/373.6
6,688,346 B2 * 2/2004 Brahier ..... B41J 3/4073 141/10
6,742,321 B2 * 6/2004 Gates ..... B65B 43/465 53/373.6
6,789,963 B2 9/2004 Brahier et al.
6,857,455 B2 2/2005 Brahier et al.
6,862,866 B2 * 3/2005 Jacobsen ..... B65B 39/12 53/469
7,024,840 B2 4/2006 Wilson, Jr. et al.
7,594,375 B2 * 9/2009 Dussault ..... B65B 57/14 53/562
7,654,064 B2 * 2/2010 Riccardi ..... B65B 43/267 53/469
7,950,205 B2 * 5/2011 Gates ..... B65G 59/08 221/45
8,484,935 B2 * 7/2013 LeBlanc ..... B65B 61/025 53/440
8,943,783 B2 * 2/2015 Ouellet ..... B65B 5/067 53/469
2002/0083684 A1 * 7/2002 Schlosser ..... B65B 39/14 53/459
2002/0108352 A1 * 8/2002 Sperry ..... B31D 5/0073 53/403
2004/0022569 A1 * 2/2004 Brahier ..... B65B 61/025 400/76
2004/0088953 A1 * 5/2004 Wilson, Jr. ..... B65B 43/36 53/469
2004/0154689 A1 * 8/2004 Brahier ..... B65B 61/025 141/10
2004/0168412 A1 * 9/2004 Greening ..... B65B 43/44 53/385.1
2006/0005553 A1 * 1/2006 Metzger ..... B65B 1/36 62/344
2006/0162291 A1 * 7/2006 Gates ..... B65B 43/26 53/469
2008/0098697 A1 * 5/2008 Murray ..... B65D 75/5883 53/457
2008/0110132 A1 * 5/2008 Yan Ruz ..... B65B 43/30 53/385.1

(56) References Cited

U.S. PATENT DOCUMENTS

| | | | | |
|---|---|---|---|---|
| 2010/0180547 | A1* | 7/2010 | Foucher | G07F 11/42 700/235 |
| 2011/0185685 | A1* | 8/2011 | Metzger | F25C 5/18 53/473 |
| 2011/0266188 | A1* | 11/2011 | Share | B65B 63/026 53/436 |
| 2012/0111449 | A1* | 5/2012 | Hsu | B65B 57/00 62/340 |
| 2012/0144779 | A1* | 6/2012 | Brinkman | B65B 43/28 53/384.1 |
| 2012/0186202 | A1* | 7/2012 | Pandurangan | B65B 43/123 53/502 |
| 2012/0227363 | A1* | 9/2012 | Nussbaum | B65B 57/08 53/374.3 |
| 2013/0255194 | A1* | 10/2013 | Metzger | B65B 43/123 53/127 |
| 2014/0013714 | A1* | 1/2014 | Lachenmeier | B65B 9/14 53/459 |

FOREIGN PATENT DOCUMENTS

| | | | |
|---|---|---|---|
| EP | 0916578 | A2 | 5/1999 |
| WO | 03053787 | A2 | 7/2003 |
| WO | 14055056 | A1 | 4/2014 |

* cited by examiner

BAGGING MACHINE AND METHOD

CROSS-REFERENCE TO RELATED APPLICATIONS

The present application is a divisional of U.S. patent application Ser. No. 15/318,708, filed Dec. 14, 2016, which is based on International Application No. PCT/US2015/036418, filed Jun. 18, 2015, which claims priority to U.S. Provisional Patent Application No. 62/013,600, filed on Jun. 18, 2014, which are incorporated herein by reference in their entirety.

FIELD OF THE INVENTION

The present disclosure relates generally to the field of automated product bagging and packaging. More particularly, the application discloses a system and assembly for presenting web material product containers, sometimes referred to as bags, with an opening configured to receive larger goods and thereafter closing the discrete web material product containers to secure the goods therein.

BACKGROUND OF THE INVENTION

Many manufacturing and shipping processes prefer packaging of various discrete quantities of bulk products in secure and robust containers that can be delivered to subsequent users or consumers of the packaged products. In various manufacturing processes, such processes require the discrete packaging of desired quantities of products, such as fasteners, seals or O-rings, assembly kits, shoes, clothing, apparel, combinations of various products, etc., that can be package in discrete product count or order specific packages and delivered to downstream manufactures, consumers, or users.

Many internet based sales activities, such as eBay®, Amazon®, source or manufacturer direct suppliers, etc., allow a user or consumer to purchase various goods and/or materials either directly from a manufacturer and/or from intermediary service providers and facilitate the delivery of the ordered goods directly to the purchaser. Many such products can be packaged in web-type material containers and delivered directly to the consumer. The web-type material containers are commonly referred to as tubes or bags and are formed of various types of plastic materials. As the desire to purchase products through non-brick and mortar or "mail order" sales streams has increased, so has the need to expeditiously, accurately, and securely package, label, and distribute various types of goods to downstream product users and consumers.

Large volume retailers have an even greater need to quickly and inexpensively bag products being sent to customers. Some companies use a continuous strip bag feeder and loader apparatus, commonly referred to as "feeder/loaders," such as those disclosed in U.S. Pat. Nos. 6,857,455; 6,789,963; and 6,688,346, owned by the Applicant. The disclosures associated with the patents cited above are expressly incorporated herein. It is appreciated that strip bag feeders such as those disclosed in the patents referenced above can be configured for sequential operation with web material containers, bags, or web material tubes having various sizes, shapes, and configurations. Commonly, the web material containers associated with use of such feeder/loaders can be provided with various separable perforations, be severable or provided a pre-formed bag opening so as to provide a series of interconnected but separable plastic product containers.

For example, similar to a bag feeder and label printer portions of the assembly described below with respect to FIG. 1, many such feeder/loaders use continuous strips of bags that are end connected or a continuous tube of bag material. Each of the bags in the continuous strip web material can include an open end or an end that is openable via at least a partial separation or perforation and that is connected to a closed or sealable end defining the next bag in the continuous strip. Additionally, many such feeder/loader assemblies can also include a printing station which prints a design and/or shipping information on label applied to the bag or directly to the discrete bag material itself as the material is fed from the roll into a respective product bag loading station. Unfortunately, many such prior assemblies suffered from various shortcomings.

Commonly, after one bag is loaded, the feeder/loader seals the bag and removes the bag from the roll. Then the feeder/loader feeds another bag from the continuous roll into a loader station. The feeder/loader interacts with at least one side of a respective bag or a bag mouth, so as to push or pull the alternate sides of a respective bag away from one another to expose the cavity of the bag for the introduction of a product. In order to provide room for the bag to be opened, sometimes referred to as the pass through, a cross member or jaw, which can include a portion of a sealing element, such as a pressure bar and/or heating element, the cross member associated with the pass through must be withdrawn away from the plane associate with introduction of each respective bag to the loading area and then re-associated with a plane associated with an edge of each respective bag to effectuate the closing or bag sealing operation. Due to the various manipulations associated with feeding, opening, loading, sealing, and separating each discrete bag, prior bag packaging assemblies were incapable of packaging goods that required a bag opening, bag mouth, or pass through constructed to accommodate products having a cross sectional diameter greater than about six inches.

As the popularity of such bag packaging assemblies increased due to their speed, accuracy, and efficiency, the need arose to increase the size of the bag so as to accommodate larger products; such as toys, boxed shoes, collections of related or unrelated items having a common destination, etc. However, simply increasing the size of the pass through, and thereby the various stroke lengths or ranges of motion associated with effectuating the desired manipulations of each discrete bag proved unworkable to provide the desired degree of accuracy or repeatability and efficiency associated with secure packaging the larger products. That is, maintaining the desired orientation of each respective bag to facilitate the various manipulations of opening, maintaining, loading, closing, and sealing of each respective bag necessary to accommodate larger product loading processes in a repeatable and efficient required more than simply increasing the size of existing automated product bagging systems.

For instance, simply increasing the stroke length associated with the various prime movers or actuators associated with prior bag packaging assemblies created less than desirable ergonomics associated with manual product packaging arrangements and detracted from product throughput rates. For those applications requiring manual product placement, increasing actuator stroke lengths required increases in the distances that personnel had to extend their arms to reach the desired product placement areas for interaction with the pass through. That is, when product loading was completed by a person, the person being further away from the mouth of the opened bag resulted in poor ergonomics resulting from the person reaching, leaning or otherwise not being in a generally upright orientation and close to the mouth of the bag during manual loading. Such configurations fail to adequately consider operator fatigue and can thereby lead to reductions in productivity and increasing staffing operational expenses.

Further, attention to the spatial requirements of the bag packaging machine needed to be considered to accommodate users having spatial constraints associated with use or operation of the packaging assembly. That is, the loader/feeder not only needed to be wider, to accommodate a larger continuous roll or source of web material, but also needed to be longer, to accommodate operation of the larger stroke cylinders. The increased footprint of the machine decreased the amount of space on the floor that a company could use for other machines or even other feeder/loaders and decreased the capacity of the company for placement of other bag packaging assemblies.

Product throughput efficiency and manufacturing cost considerations also needed to be addressed to develop a bag packaging machine that could be beneficially utilized for both smaller and larger product shapes. Simply increasing the stroke length of previously acceptable actuator configurations proved to be detrimental to product throughput due to cycle times associated with the cyclic operation of product bagging machines. Manipulating the size and/or operating modality associated with operation of previously accepted prime movers or actuators, i.e. pneumatic, electric, hydraulic and/or combinations thereof, required consideration of manufacturing as well as packaging machine operating and maintenance costs.

Another consideration necessary to the intended desired utilization and operation of such product packaging assemblies relates to the adjustability of the operation to accommodate use of the assembly with different sized product bags. That is, consumer acceptance would be substantially limited were such an assembly provided in a configuration where only containers or bags having only a smaller or larger than the previously customary six inch bag opening or throat dimension usable with the underlying assembly.

Many prior smaller bag capacity machines required the machine be taken off-line or rendered unusable when personnel or maintenance technicians configured the machine for use of alternate less than six or fewer inch bag opening sizes. Such setup commonly constitutes at least partial disassembly of the feeder/loader to adjust the stroke of the cylinders to accommodate the size of the continuous roll of bags and/or desired bag mouth or throat opening. Downtime associated with such setup procedures commonly results a significant decrease in productivity of the facility as well as decreased utilization of the underlying packaging machine system. Accordingly, in addition to utilization of the packaging system with a wider variety of bag sizes and shapes, another objective associated with the present application was to provide a bag packaging assembly that could accommodate operation with various bag sizes and could be efficiently configured for use across the range of usable bag sizes.

Therefore, there is a need for product bagging assembly or machine that can accommodate a number of sizes of continuous rolls of bags and a number of different mouth openings larger than the previously acceptable six inch diameter maximum bag opening. There is also a need to provide a product bagging assembly that provides packaged product throughput rates comparable to or even faster than previously available product bagging assemblies. There is a further need to provide a product bagging assembly that can be quickly and efficiently configured for utilization with bags having various sizes and configurations and a product bagging assembly that is operable in various configurations without substantially detracting from the spatial requirements associated with use and implementation of such product bagging assemblies. It would also be desirable to provide such a product bagging assembly in a configuration wherein the product bagging assembly could be configured to cooperate with previously acquired bag delivery or feed assemblies, label printer assemblies, and/or the control systems associated with operation of such previously acquired systems.

SUMMARY OF THE INVENTION

The present application discloses a product bagging system and method of bagging product that overcomes one or more of the drawbacks disclosed above. One aspect of the present application discloses a product bagging assembly and method of manipulating a web material bag that is operable to create a bag opening that is greater than six inches and which is operable without substantially detracting from product throughput associated with use and operation of the product bagging assembly. In a preferred embodiment, the bag opening/closing assembly includes a first actuator and a second actuator that are connected to one another such that a position of one of the actuators can be manipulated by operation of the other actuator. The product bagging assembly can be provided as a kit configured for substantially "plug and play" operation with previously acquired bag and product delivery systems.

Another aspect of the invention useable with one or more of the features above discloses a product bagging system that includes a bag feed system that is configured to communicate a presented bag from a sequence of bags to a product loading area. A bag open assembly is movable relative to the loading area between a bag closed position and a bag open position. The bag closed position is defined as the generally opposite sides of a presented bag being generally adjacent one another and the bag open position being defined as the generally opposite sides of a presented bag being spaced from one another to define a bag loading opening, mouth, or throat that extends generally along at least a portion of an edge of each presented bag. The assembly includes a first actuator and a second actuator that are each selectively operable to manipulate a position of the bag open assembly relative to the loading area and operation of one of the first actuator and the second actuator manipulates a position of the other of the first actuator and the second actuator relative the loading area. Said in another way, operation of the first actuator and the second actuator is stacked such that operation of one actuator can manipulate the position of the second actuator, independent operation of the second actuator, relative to a presented bag to move the bag open assembly from the open position to the closed position in less time required for a single actuator having a stroke length equal to the sum of the stoke lengths of the first and second actuators.

Another aspect of the present application discloses a method of manipulating a web material bag for sealed packaging of product in discrete web material bags that includes introducing a tensioner to one of two adjacent sheets that define a bag presented to a product loading area and such that the tensioner cooperates with opposing edge portions of an opening of the bag. The method further includes separating the two adjacent sheets of the bag in an opening direction oriented in a crossing direction relative to the tensioner to define a product receiving opening having a cross sectional area defined by a diameter that is greater than six inches.

Another aspect of the present application that is usable or combinable with one or more of the above aspects discloses a kit that is configured to cooperate with a product bagging machine having a bag feed assembly and a bag sealer arrangement. The kit includes a chassis that is configured to support a pressure plate and is securable to the bag feed assembly. A carriage is disposed between the chassis and pressure plate and movable relative to the chassis. An actuator is disposed between the carriage and the pressure plate such that motion of the carriage and operation of the actuator can each affect the position of the pressure plate relative to the chassis.

It will be understood by those skilled in the art that one or more advantages, aspects, and/or objects disclosed in the present application can meet certain objectives, while one or more other aspects can lead to certain other objectives. Other objects, features, aspects, benefits and advantages of the present application will be apparent in this summary and the forthcoming description of the disclosed embodiment, and will be readily apparent to those skilled in the art. Such objects, features, benefits and advantages will be apparent from the above and taken in conjunction with the accompanying figures and all reasonable inferences to be drawn therefrom.

BRIEF DESCRIPTION OF THE DRAWINGS

The drawings illustrate preferred embodiments presently contemplated for carrying out the present invention.

DETAILED DESCRIPTION

Figure 1:
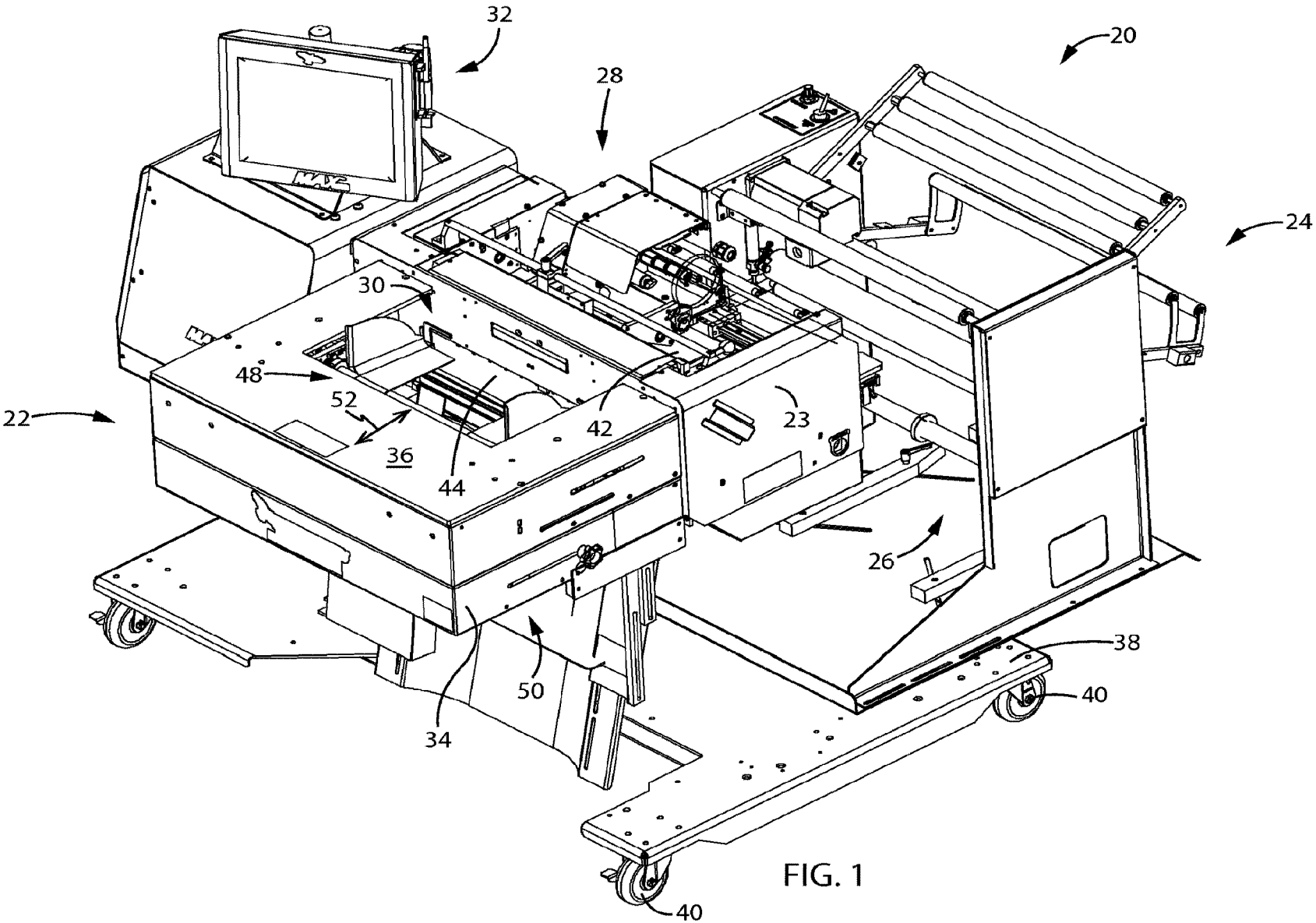
FIG. 1 is a front perspective view of a product bagging assembly according to the present invention associated with bag delivery and label printing systems.

Referring to FIG. 1, a product bagging system 20 includes a product loading station or product bagging assembly 22 according to the present invention. Product bagging system 20 includes a bag feeder/loader or bag delivery 23 that is associated with a payoff system 24 that includes a roll support or loading station 26. A bulk volume, such as a roll or folded supply, of web material is associated with or supported by loading station 26, passed through payoff system 24, and delivered to a printing station 28 prior to being communicated to a product pass through 30 associated with product bagging assembly 22 via bag delivery system 23.

In one embodiment, a roll, which can be a continuous roll of plastic material bags, which may be partially perforated along intended tear or bag opening lines, is fed from roll loading station 26, up through a number of rollers associated with payoff system 24, to the printing station 28. In one embodiment, each bag, while in the continuous roll or folded arrangement of what will ultimately define multiple discrete product containing bags, is attached to the neighboring bags by perforations. Each bag is generally defined by a front side and a back side that are bounded by edges. One or more of the left side edges, right side edges, and bottom edges can be sealed and the top edge or area proximate thereto can be provided with an open or partially perforated top edge portion which can be selectively opened or severed during the product loading process and subsequently sealed to secure the packaged contents within the confines of a respective bag.

In some configurations, the top of the rear or back portion of the bag is attached to the neighboring bag by the above described perforations. Disposed generally proximate the top of the front of the bag is a mouth or lip of the bag that is only attached to the rear portion of the bag at the right side and left side and is free to be manipulated as will be further discussed below. Alternatively, selectively tearable perforations can be formed proximate or at the top edge associated with the front and rear sides of a respective bag and severable to define a desired opening size and shape of each respective bag during product loading. It should be appreciated that the description above is merely exemplary of a few of many web material containers useable with product bagging system 20.

Regardless of the web material utilized, at the printing station 28, signage, such as a graphic associated with identification of the contents of a package, product or supplier designs such as a company's logo or trademark, as well as shipping information and/or instructions, for example fragile, is preferably printed directly on the bag or printed to a label adhered to a respective bag. After a portion of the web material or a respective label has been printed and/or adhered to a respective bag, a portion of the web material associated with forming a discrete product bag advances to product pass through 30 and is manipulated by operation of product bagging assembly 22 to open the respective bag to have a desired opening, throat, or mouth size and shape for receipt of respective product as described further below.

Product bagging system 20 includes a control system 32, such as computer, that is configured to control the desired sequential operation of one or more of bag feeding system 20, payoff system 24, loading station 26, and/or printing station 28 to effectuate the desired respective operations thereof during a product packaging process. It is appreciated that control system 32 can be configured to receive operational instructions directly from user personnel, such as via a mouse, keyboard, touch screen, or other inputs such as flash drives and/or network connections. As disclosed further below, control system 32 may be programmed to determine how much stroke is available and/or needed from each set of actuators for any given bag opening width and length desired. In one embodiment, control system 32 is pre-programmed with the available stroke for each set of actuators and configured to allow each set of actuators to be selected for use alone or in combination. Such a consideration reduces the user interaction required to effectuate operation of product bagging assembly 22 in a desired manner from various available product throughput configurations as disclosed further below.

Still referring to FIG. 1, product bagging assembly 22 of product bagging system 20 includes a chassis 34 and a shroud 36 or the like associated with selectively isolating the internal workings of product bagging assembly 22 from dirt, debris, product to be packaged, as well as users or operators. Product loading station 20 can further include one or more hand stations or contacts associated with providing a user's confirmation that the desired product has been associated with pass through 30 and/or the open bag disposed generally thereunder. Although shown in what is commonly understood as a vertical loading configuration, it is appreciated that one or more of product loading station 20, printing station 28, payoff system 24, and/or bag feeding system 20 can be rotationally supported so as to provide vertical, horizontal, or canted or pitched user interaction with product packaging system 20 and specifically product loading station 20. In a preferred embodiment, product packaging system 20 is supported by a cart 38 having one or more casters 40 to accommodate desired or various placement of system 20 within a given operating environment.

Still referring to FIG. 1, bag deliver system 23 includes a conveyor 42 configured to move the web material associated with the strip of bags toward pass through 30 via a channel or slot 44 formed through facing sides of the bag delivery system 23 and the product bagging assembly 22. Product bagging assembly 22 opens respective bags and then, after product loading, seals the respective bags prior to introduction of a subsequent bag to the space associated with product pass through 30. It is appreciated that chassis 34 and shroud 36 of product bagging assembly 22 could be formed of multiple connected panel-like structures and/or formed as a more unitary structure such that product pass through 30 defines a product inlet 48 and a bagged product outlet 50 that generally overly one another.

It is further appreciated that shroud 36 and chassis 34 can optionally cooperate with one another in a movable manner such that the guard can slide in and out in a direction aligned with the direction of bag introduction, as indicated by arrow 52, relative to one another to provide variable sized product pass through inlet 48 sizes based upon the size of products intended to be packaged. The ability to adjust shroud 36 relative to chassis 34 ensures that, when product is manually loaded, loading personnel are permitted as close as operational permitted relative to inlet 48 to provide an ergonomically desirable position of loading personnel across a range of usable product and bag sizes. Other means of providing an adjustable shroud 36 are envisioned and would not defeat the spirit of the invention.

Figure 2:
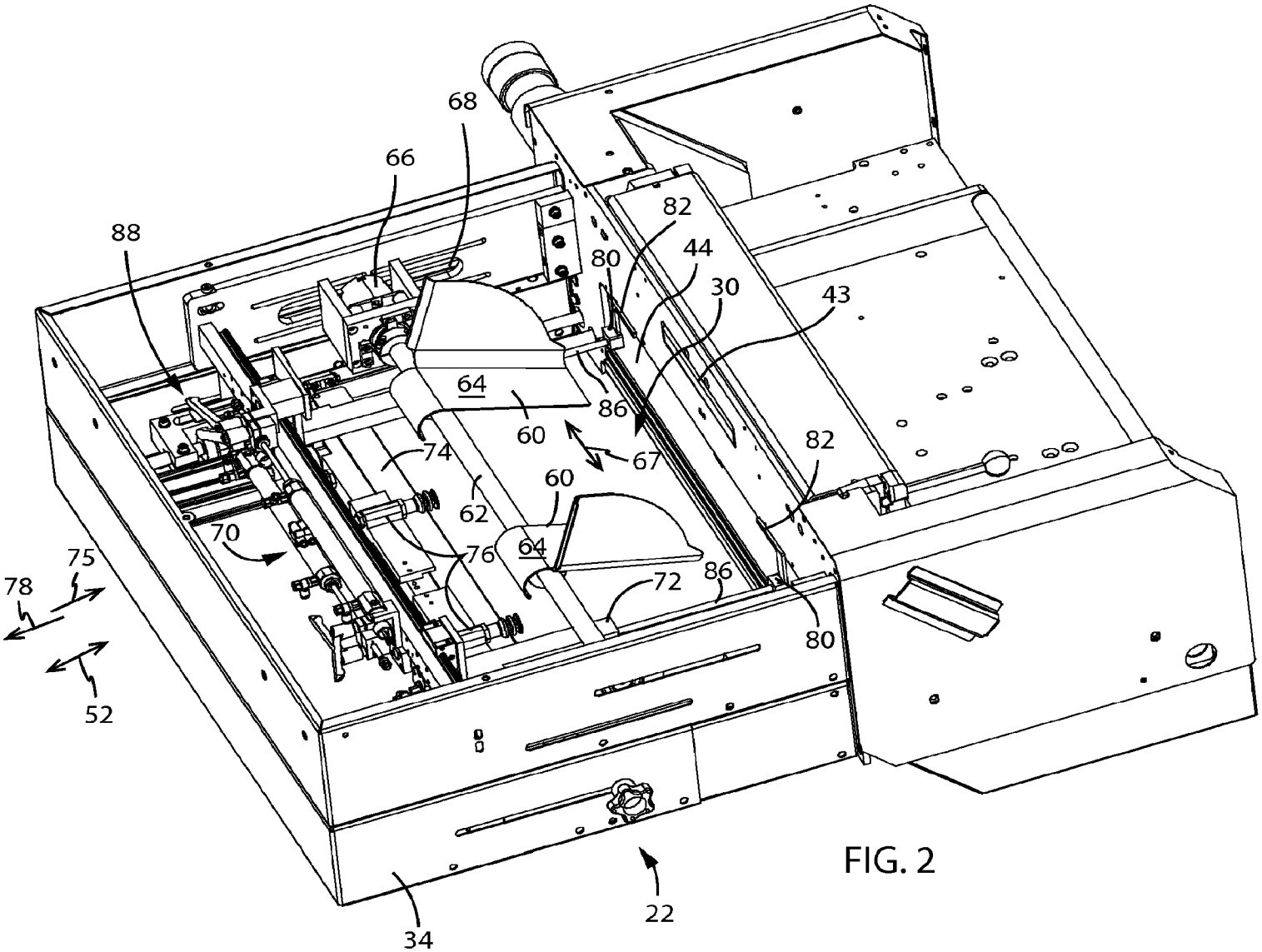
FIG. 2 is a view similar to FIG. 1 of the product bagging assembly associated with a frame that underlies the label printing system shown in FIG. 1.
Figure 3:
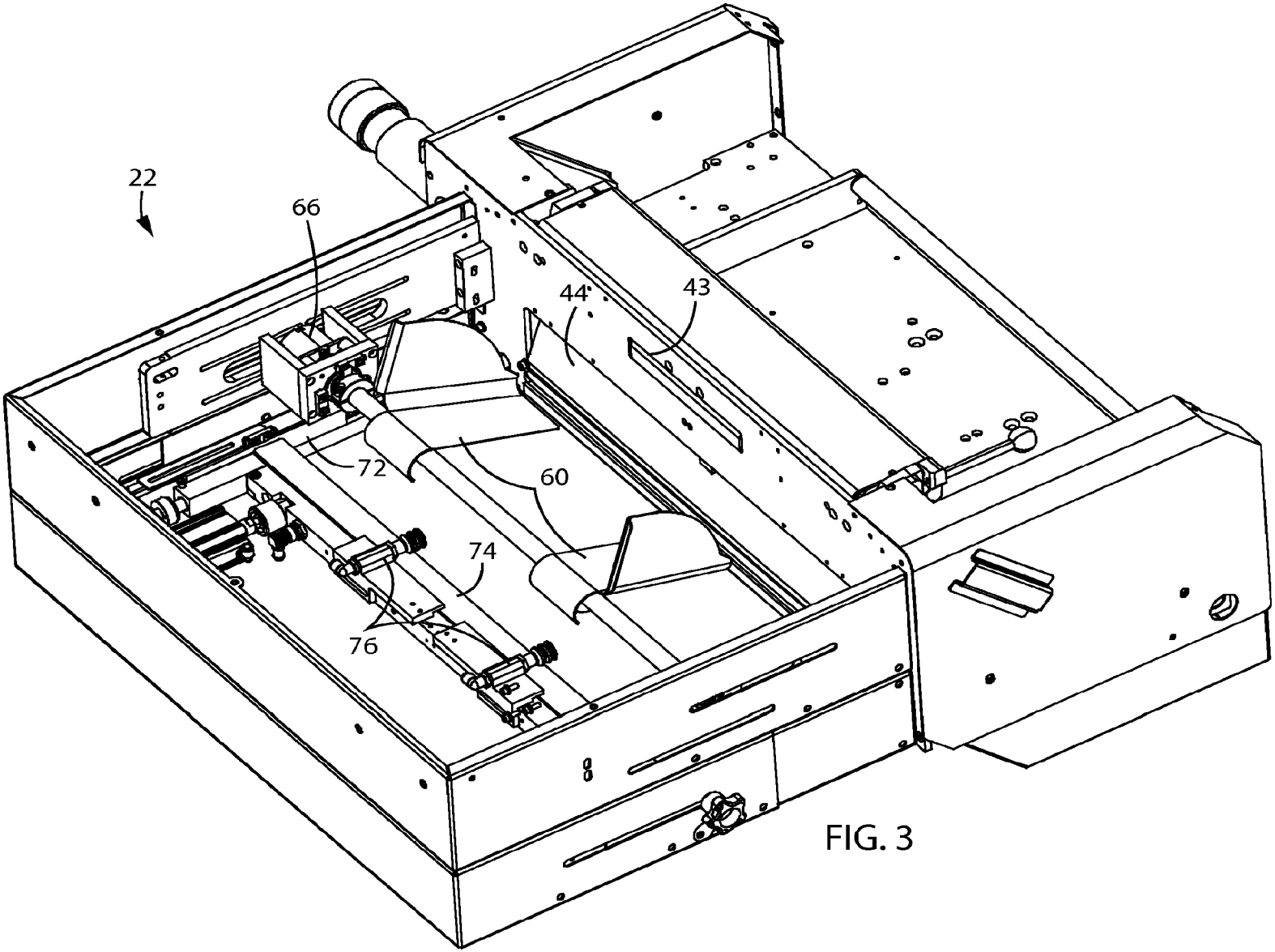
FIG. 3 is a view similar to FIG. 2 with a rotational bag opening edge tensioning system removed therefrom.
Figure 4:
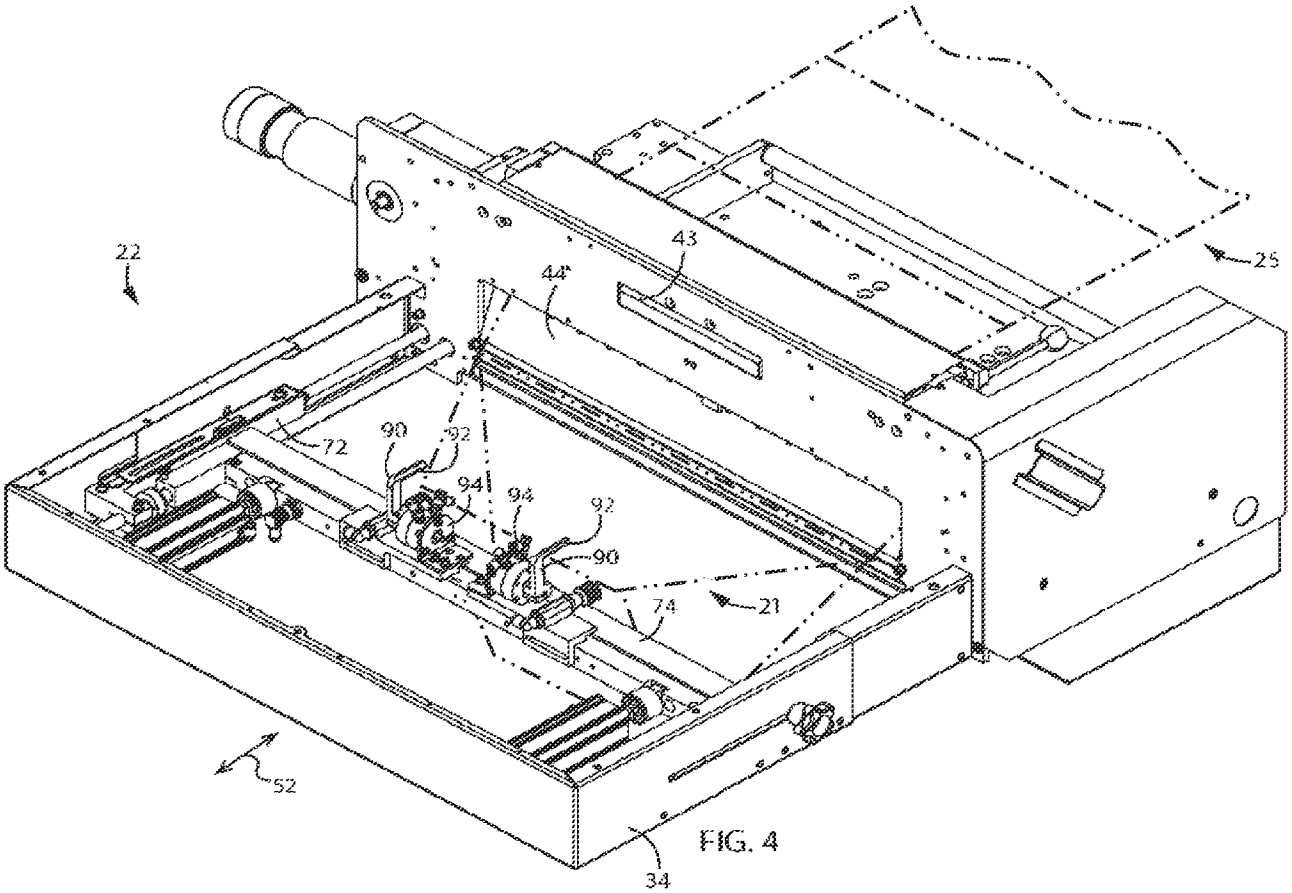
FIG. 4 is a view similar to FIG. 3 with an optional physical bag opening/tensioning system associated with the product bagging system.

FIGS. 2-4 show product bagging assembly 22 with shroud 36, various chassis portions, and various bag opening or manipulating assemblies selectively removed from bagging assembly 22. As described further below, it will be appreciated that product bagging assembly can be individualized to achieve the desired operation of product bagging assembly 22 associated with different product and bag shape, size, and configurations.

Product bagging assembly 22 is configured to receive or cooperate with various bag manipulating structures to effectuate a desired opening, packaging, closing, and sealing of a respective empty and packaged product bag. Referring to FIG. 2, product bagging assembly 22 can include one or more product guides 60, supported by a rotatable shaft 62 that is fixed or slideably supported by chassis 34. Upon introduction of a bag to product pass through 30 via slot 44, guides 60 are shaped to accommodate passage of a product along an upper surface 64 generally between the guides and into the volume of an opened bag. Preferably, guides 60 slideably cooperate with shaft 62 in a generally lateral direction, indicated by arrow 67, to accommodate use of guides 60 with bags of various widths.

A drive device 66, such as a motor, cooperates with shaft 62, to attain the desired orientation of guides 60, relative to a staging and loading process. One or more slots 68 associated with chassis 34 can be provided to accommodate a slideable cooperation of shaft 62 in bag opening and closing direction 52 relative to slot 44 to facilitate use of guides 60 throughout the loading process or use of a guide or guides having other shapes. Alternatively, it is appreciated that guides 60 could be biased out of interference with manipulation of bag opening assembly and deflectable in response to user interaction to tilt product into an underlying open bag. It is further appreciated that for some manual and many automated product packaging processes, guides 60 may be omitted or removed from product bagging assembly 22.

As alluded to above, a bag opening assembly 70 is supported by a carriage 72 that is slideable relative to chassis 34 in directions 52. A pressure plate or cross member 74 supports one or more bag tensioning or opening devices 76, such as vacuum assist devices, configured to engage a front facing side of each respective bag. During packaging processes, cross member 74 moves in a closing direction 75 or toward slot 44 to engage bag and subsequently an opening direction 78 to effectuate separation of the alternate sides of a respective bag and thereby forming the opening or mouth associated with the underlying bag. It is appreciated that in some applications, air knife 43 may provide a sufficient open configuration for bags having a hysteresis capable of maintaining an open mouth orientation such that cross member 74 need not engage a respective bag. Commonly, only smaller sized bags are capable of such use of product bagging assembly 22.

In one mode of operation, after a product has been disposed in a respective bag, cross member 74 returns toward slot 44 and compresses a respective bag 21 against a sealing assembly disposed proximate thereof. Before the pressure bar or cross member 74 retracts or disengages the top of a respective bag 21, conveyor 42 can operate in a reverse direction to tear perforations between discrete bags 21 associated with a roll 25 of bags to effectuate separation of a packaged bag 21 from the remaining web material. Once a packaged bag 21 is torn from the roll 25 of bags, cross member 74 can translate in an opening direction associated with product pass through 30 such that the packaged bag 21 drops out of the product bagging assembly. Understandably, other means are known in the industry for separating perforations or even bags, for example using a knife, pulling, pinching or burning, and the use of which would not defeat the spirit of the invention.

When utilized, bag opening devices 76 can slideably cooperate with cross member 74 to achieve the desired positioning of opening devices 76 relative to discrete bags 21 delivered through slot 44. That is, devices 76 can be positioned nearer one another for smaller bags 21 and further from one another for larger bags 21. Bag opening assembly 70 can also include one or more optional tensioners or bag edge retainers 90 that are rotatable about an axis generally aligned with direction 52. Initial opening of a bag 21 can be effectuated by air knife 43 and/or the rotation of one or more fingers 92 associated with retainers 90 into the opening of a respective bag 21 during the opening, loading, and closing of a respective bag 21. Depending on the configuration of the utilized bags 21, fingers 92 and the translation of cross member 74 may cooperate with one another to form a desired bag mouth opening by separation of a partial opening perforation associated with the underlying bag 21. When used to effectuate such manipulation, fingers 92 and cross member 74 cooperate with one another to maintain a secure edge between the opposing faces of each respective bag 21.

Depending on the operational packaging parameters, in some situations it may be preferred to have a wide, but narrow opening, a generally rectilinear or square shaped bag opening, or other bag opening shapes. Cross member 74 and fingers 92, or other finger orientations as described above and below, can each be adjusted to provide the desired bag opening shape. The fingers 92 could also be positioned laterally to help create the rear boundary or trapezoidal shapes associated with the bag openings. If suction mechanisms are utilized as bag opening devices 76, the suction mechanisms can be laterally set relative to shaft 62 to create the desired width of the bag opening. The exact distance between the guides 60 fingers 92, and suction mechanisms 76 can each be independently adjusted to create a bag opening having a desired shape associated with the size of the bag 21 utilized for various bag 21 sizes.

In a preferred embodiment, retainers 90 are also translatable in directions 52 to provide securing of sides of the respective bag 21 that extends between slot 44 and cross member 74 during the bag 21 opening and closing operations. Such a consideration allows each bag 21 to be presented with a generally taut edge associated with the mouth of a respective bag 21 and generation of flat bag edge during the closing and sealing processes. Understandably, such manipulations may only be utilized during operation of bagging assembly with larger bags 21 suitable to larger product shapes.

Referring to FIGS. 3 and 4, retainers 90 and the drive system associated therewith, may be omitted or removed if utilization of product bagging assembly 22 is intended to be utilized with bags 21 having smaller cross-sectional opening shapes or if other retaining assemblies are utilized. For instance, as shown in FIG. 4, one or more forward oriented retainers 90 may be supported by cross member 74 and movable with carriage 72. Retainers 90 include a finger 92 and are connected to a drive arrangement 94 configured to provide selective rotation of retainers 90 in a direction generally aligned with cross member 74 to allow the selective cooperation of fingers 92, with the volume associated with a respective bag 21.

It is envisioned that for some applications, retainers 90 will provide sufficient bag tension to tolerate operation of product bagging assembly without or without operation of vacuum tensioners 76. It is further appreciated that product guides 60 and the drive arrangement or device 66 associated therewith, may also be omitted or selectively included with product bagging assembly 22 depending upon the nature of the product and the size of the bags associated with use thereof. When utilized, each retainer 90 is supported by a shaft 86 that extends to a retainer drive assembly 88 associated with carriage 74. Drive assembly 88 is operable to effectuate the desired rotation of fingers 82 into and out of the cavity associated with a respective bag.

Referring to FIGS. 5-8, cross member 74 is movable in directions 52 between a bag closed position or orientation 100 (FIG. 5), a first bag open position, 102 (FIG. 6), and a second bag open position, 104 (FIGS. 6 and 7) via operation of one or more prime movers or actuators 106. 108; 110, 112. As explained further below with respect to FIGS. 9-11, a third bag open position can be attained between first and second bag open positions 102, 104 via controlled or desired operation of actuators 106, 108; 110, 112. As disclosed further below, it is further appreciated that each of the various bag open positions can be adjusted such that infinite bag open or product pass through dimensions can be achieved with product bagging assembly 22.

Although each of prime movers 106, 108, 110, 112 are shown as pneumatic linear actuators, it is appreciated that prime movers 106, 108, 110, 112 having other operational methodologies, such as electric, pneumatic and/or combinations thereof, may be utilized. Preferably, prime movers 106, 108, 110, 112 are configured to operate a rate that is not detrimental to product throughput and can accommodate the desired manipulations of the underlying bag between the open, load, close, and seal process without damaging the underlying bag and/or packaged product.

Figure 5:
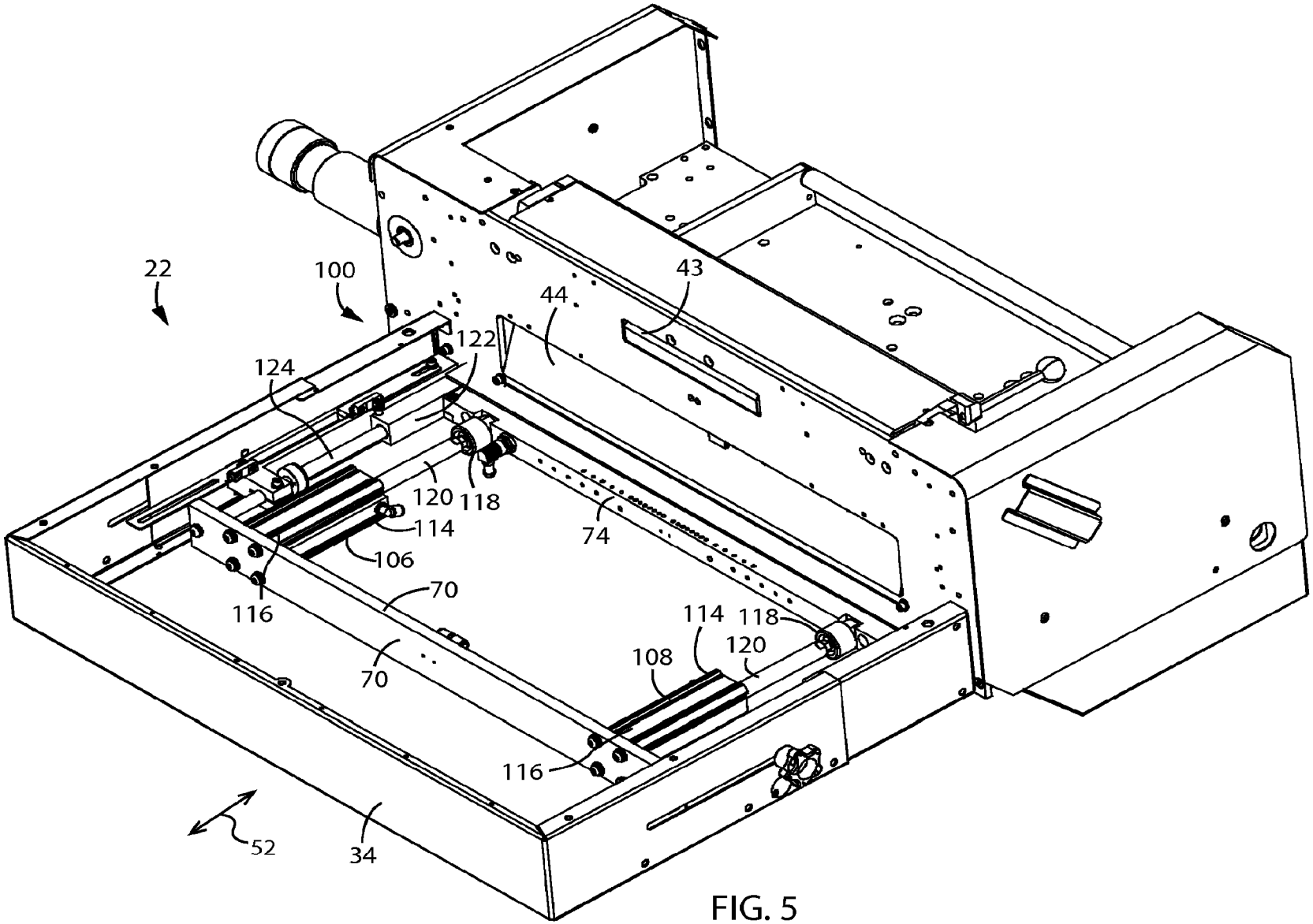
FIG. 5 is a view similar to FIG. 2 and shows the bag tensioning systems removed from a cross member of the bag open assembly with the cross member in a bag closed or first position relative to a bag feed slot.
Figure 7:
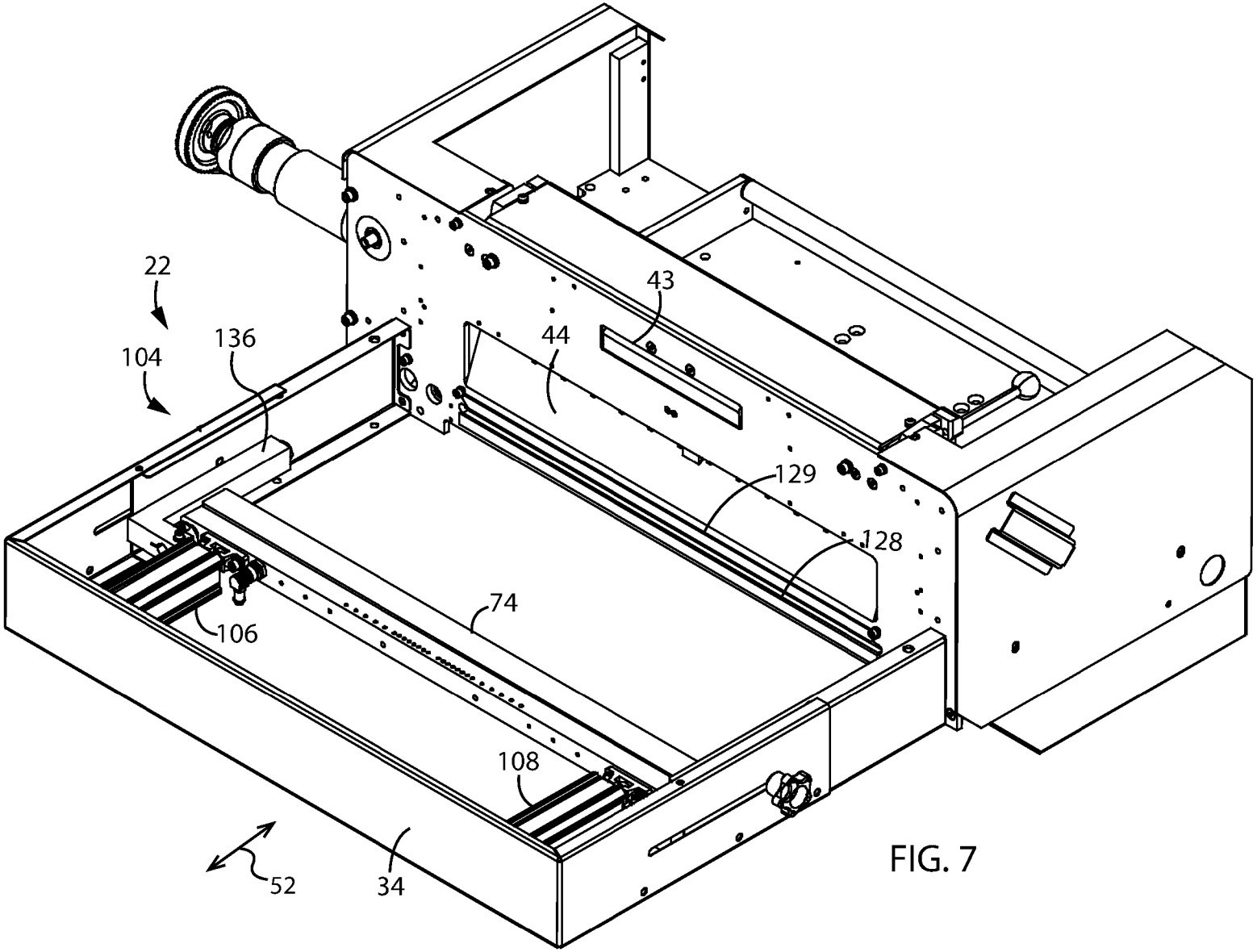
FIG. 7 is a view similar to FIG. 6 with the cross member oriented in a second bag open or pass through orientation relative to the bag feed slot.

Prime movers 106, 108 each include a housing 114 having a first end 116 that is supported by carriage 72 and a second end 118 associated with a shaft 120 (FIG. 5) that is extendable and retractable relative to the respective housing 114, Opposite ends 122 of cross member 74 slideably cooperate with a shaft 124 during operation of actuators 106, 108, 110, 112 to accommodate the slideable motion of cross member 74 between the fully closed orientation 100, as shown in FIG. 5, and the fully open orientation 104, as shown in FIG. 7, As disclosed further below, it is appreciated that cross member 74 can achieve virtually infinite bag open orientations between the bag close closed position 100 and a maximum bag open position 104.

Figure 6:
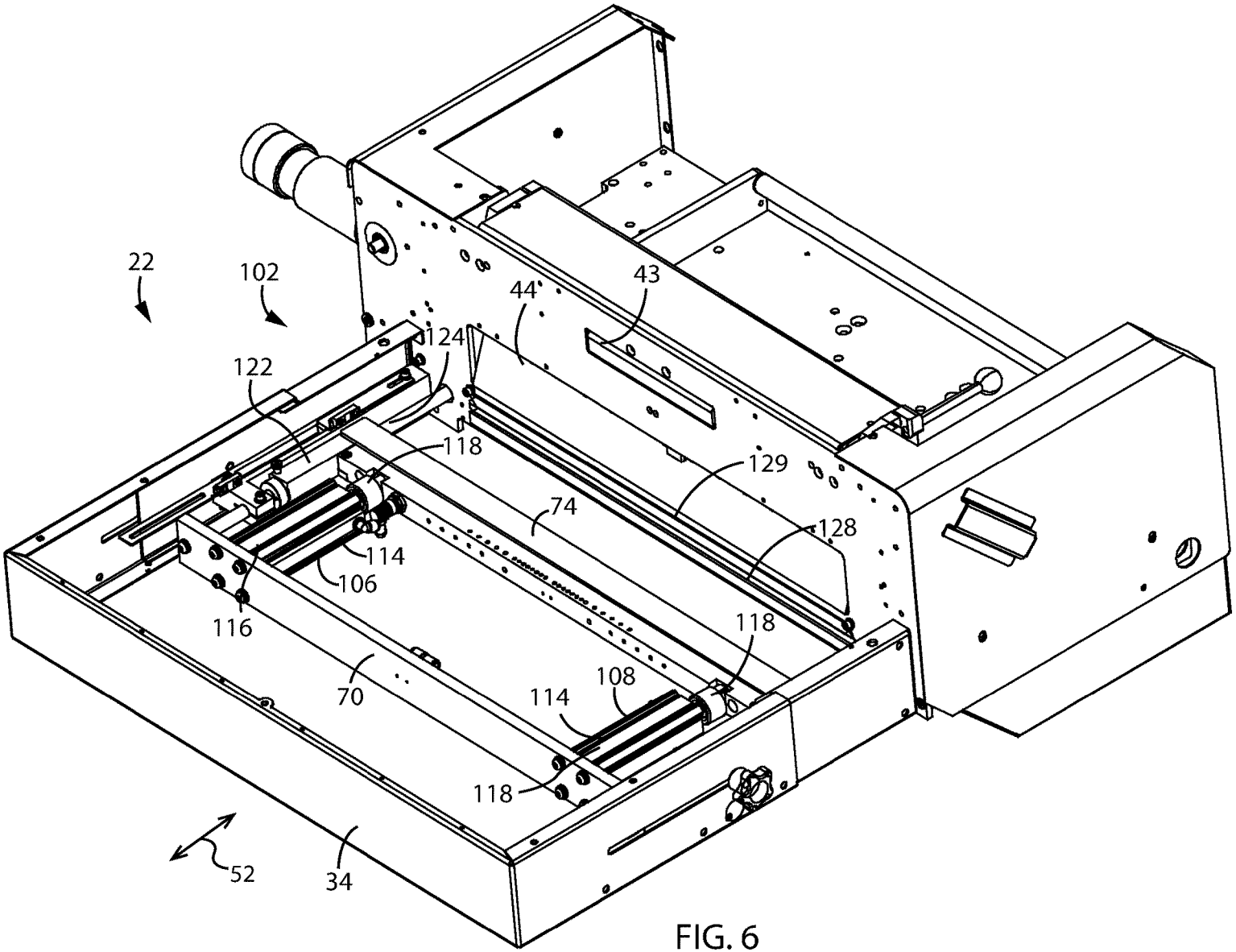
FIG. 6 is a view similar to FIG. 5 with the cross member oriented in a first bag open or pass through orientation relative to the bag feed slot.

Referring to FIGS. 5 and 6, when in the closed orientation 100 shown in FIG. 5, cross member 74 presses a bag disposed against the cross member against a seal 128 disposed proximate bag slot 44. A bag seal element (not visible), such as a heat bar, is extendable and retractable relative to seal 128 such that the bag seal element can be selectively exposed to the pass through 30 to be proximate to or contact a respective bag disposed against cross member 74 to effectuate the bag sealing process after a bag has been loaded and closed via operation of movable members of the product bagging assembly 22.

It is further appreciated that a cutting element 129 could be disposed proximate seal 128 generally above and/or below the seal element to effectuate separation between adjacent bags during product packaging operations for bags that are not provided with a pullable separation structure, such as a bag edge or end perforation feature. It is further appreciated that other bag sealing methodologies can be utilized such as gluing, bonding, crimping, etc., such that the heat bar could be omitted depending the users preferences.

Referring to FIGS. 8-11, actuators 110, 112, each include a housing 130 that is positionally secured to a frame 132 that generally underlies bag feeder/loader 23. A ram or shaft 134 slideably cooperates with housing 130 of each respective actuator 110, 112, to extend and retract an arm 136 secured to a distal end 138 of each respective shaft 134. Operation of actuators 110, 112 effectuate translation of arms 136 in bag open and close directions 52.

Arms 136 cooperate with shafts 124 and carriage 72 to effectuate translation of the entirety of actuators 106, 108 during operation of actuators 110, 112 relative to chassis 34 and in direction 52 independent of the operation of actuators 106, 108. Conversely, actuators 106, 108 cooperate with cross member 74 such that cross member 74 is independently movable in direction 52 in response to operation of either of actuators 106, 108 or actuators 110, 112.

Figure 8:
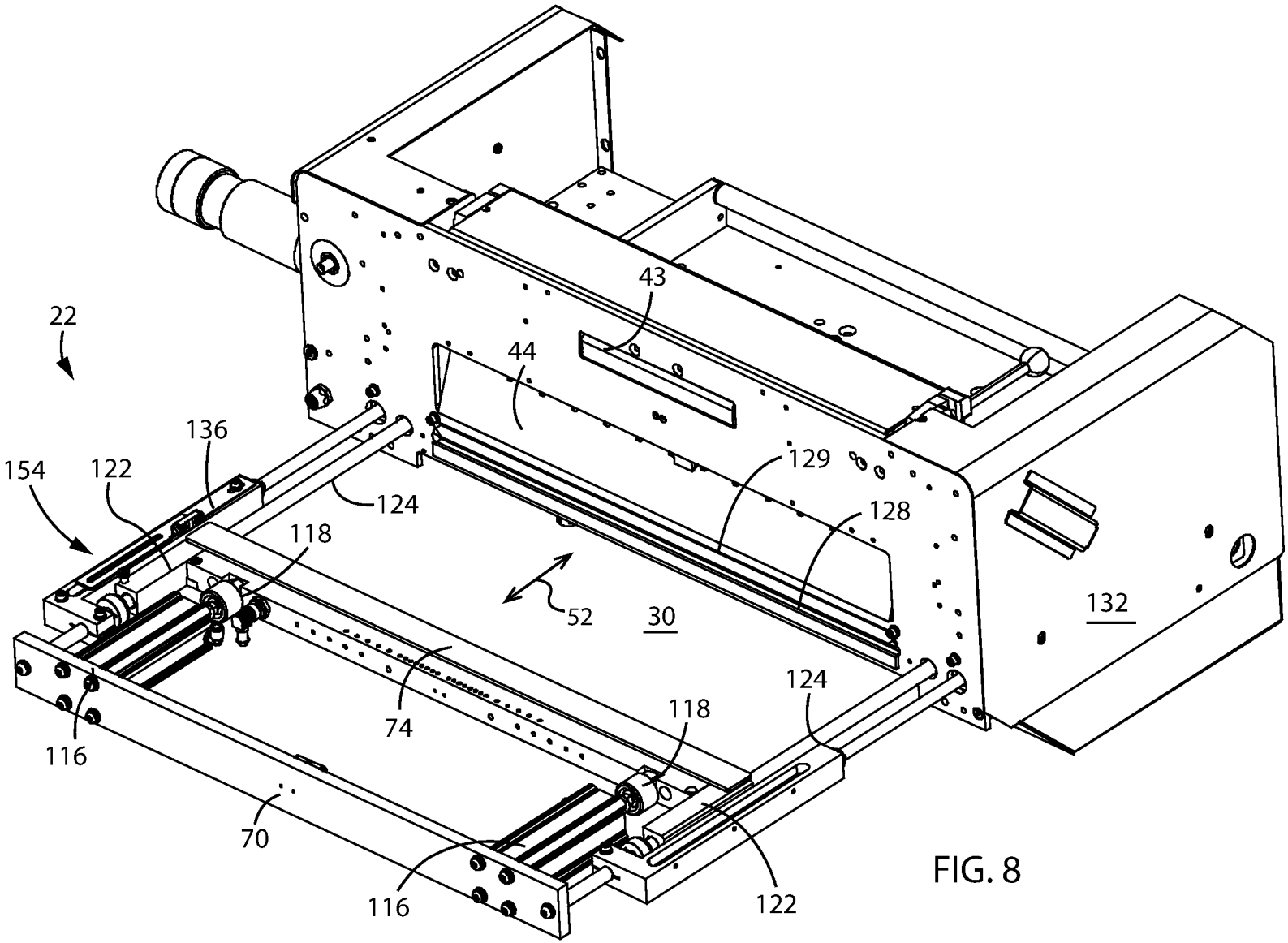
FIG. 8 is a view similar to FIG. 7 with a chassis removed from the product bag packaging assembly shown therein.
Figure 9:
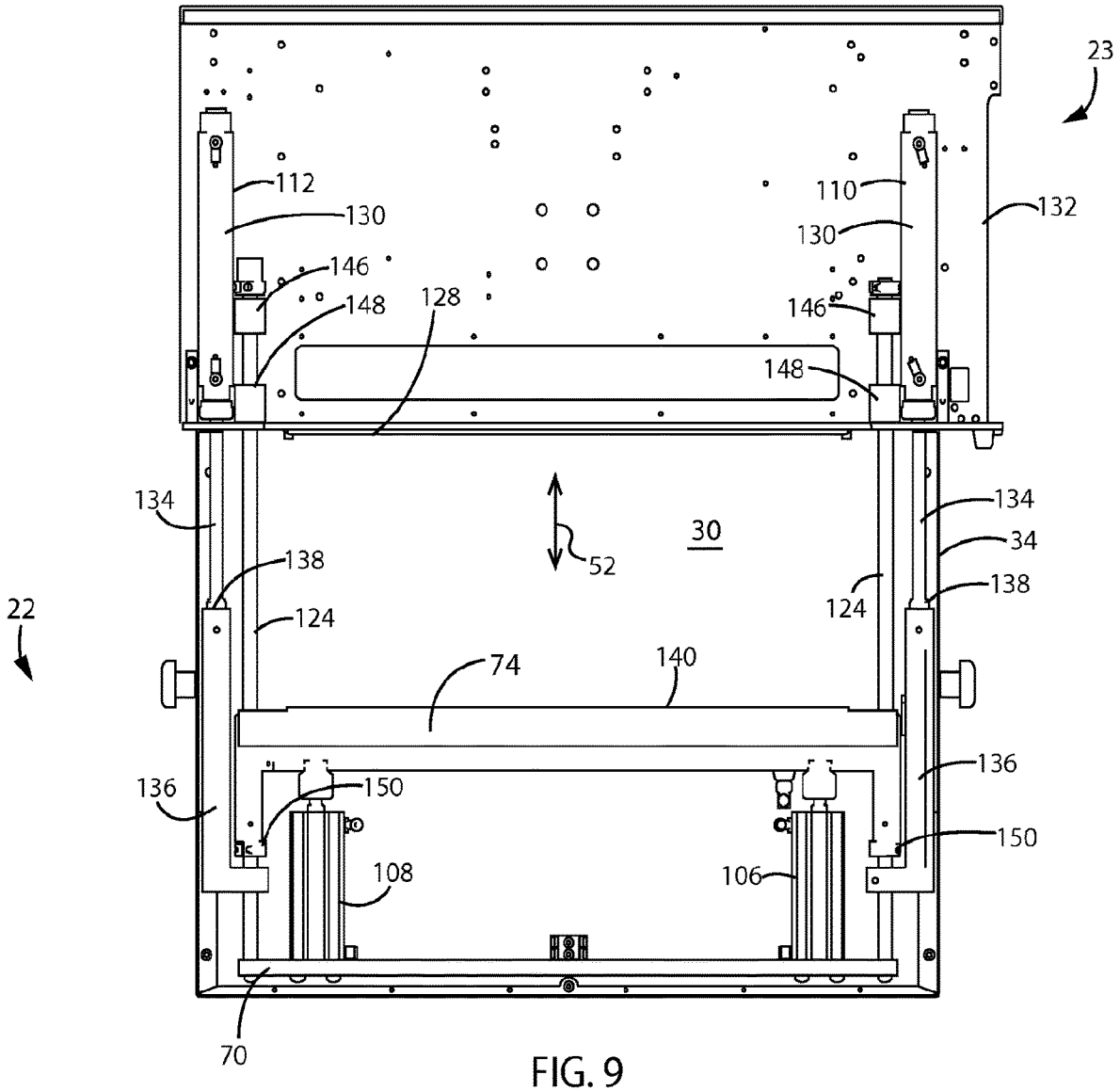
FIG. 9 is a bottom plan view of the portion of the product bag packaging assembly in the second orientation shown in FIG. 7.

Referring to FIGS. 8 and 9, when actuators 106, 108 are fully retracted and actuators 110, 112 are fully extended, the orientation of cross member 74 relative to chassis 34 defines a maximum dimension of the cross-sectional shape associated with product pass through 30. In a preferred embodiment, the distance between seal 128, and a bag facing face 140 associated with product pass through 30 is approximately at least 10 inches. Concurrent operation of actuators 106, 108 in an extension direction and actuators 110, 112 in a retraction direction allows translation of cross member 74 in bag closing direction 75 at nearly twice the operational speed associated with operation of only set of actuators 106, 108 or 110, 112. The speed of operation associated with translation of cross member 74 in bag opening direction 78 is similarly increased by concurrent actuation of actuators 106, 108, 110, 112. Said in another way, the operation of actuators 106, 108, 110, 112 is stacked to accommodate greater translation dimensions without substantially detracting from cycle times associated with use of product bagging assemblies 22 for larger sized bags. It should be appreciated that faster operating actuators, such as electric actuators could be utilized as a viable alternative to providing a desired larger product throughput dimension while maintaining desired product packaging cycle times.

Figure 10:
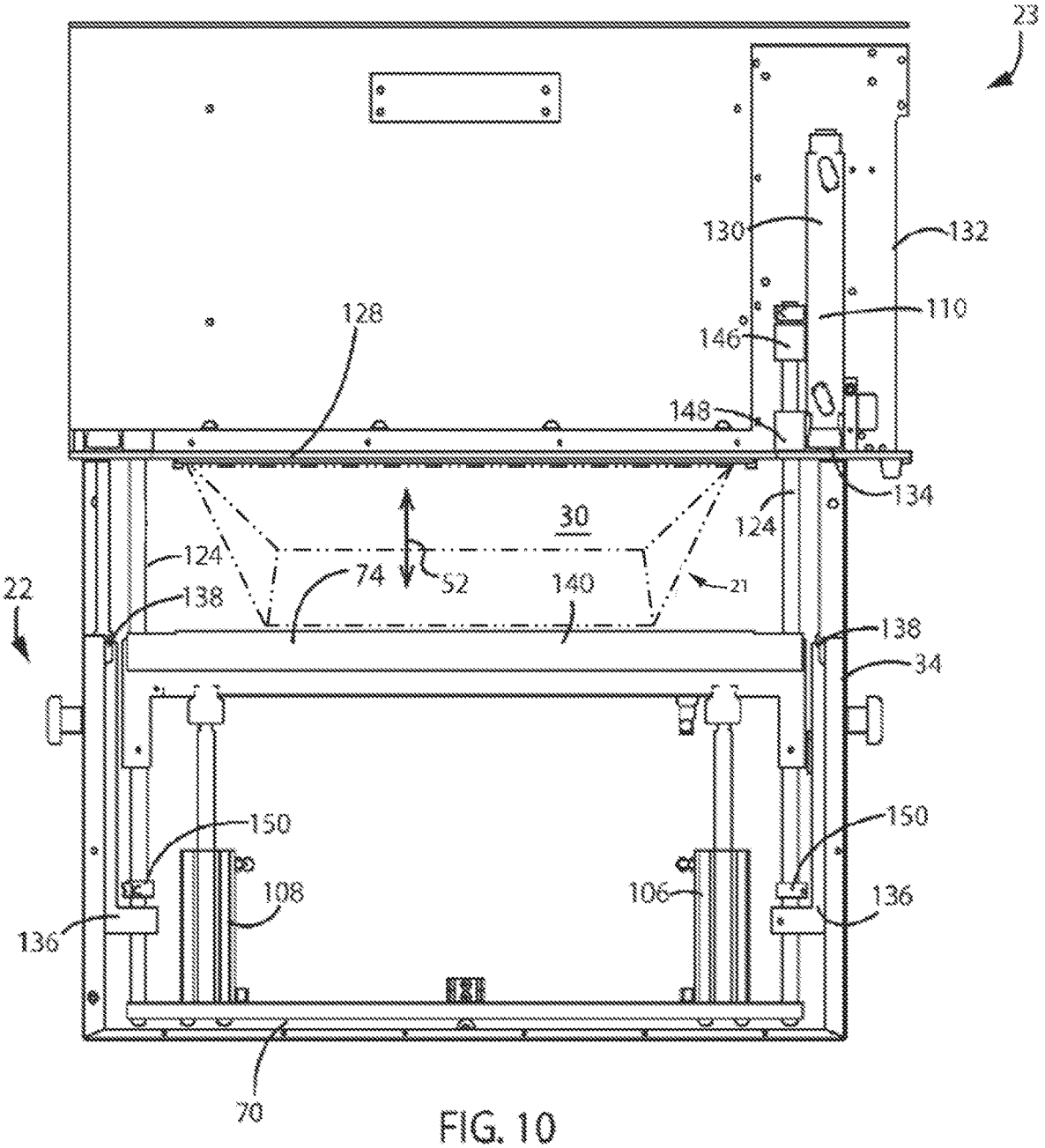
FIG. 10 is a view similar to FIG. 9 with the product bag packaging assembly in an orientation between the first and second orientations shown in FIGS. 6 and 7.

Referring to FIG. 10, when actuators 106, 108 and actuators 110, 112 are extended, the distance between seal 128 and face 140 of cross member 74 associated with product pass through 30 is approximately 6 inches. Operation of actuators 110, 112 between the extended and retracted position allows cyclic operation of product bagging assembly 22 between a bag closed position wherein cross member 74 touches or approximately touches seal 128 and a fully open orientation wherein approximately six inches is associated with the depth of the product pass through 30. Said in another way, if an approximately six inch pass through dimension is all that is required for a given product packaging sequence, actuators 106, 108 can be maintained in an in-active state such that the cyclic translation of cross member 74 is effectuated by operation of actuators 110, 112.

Figure 11:
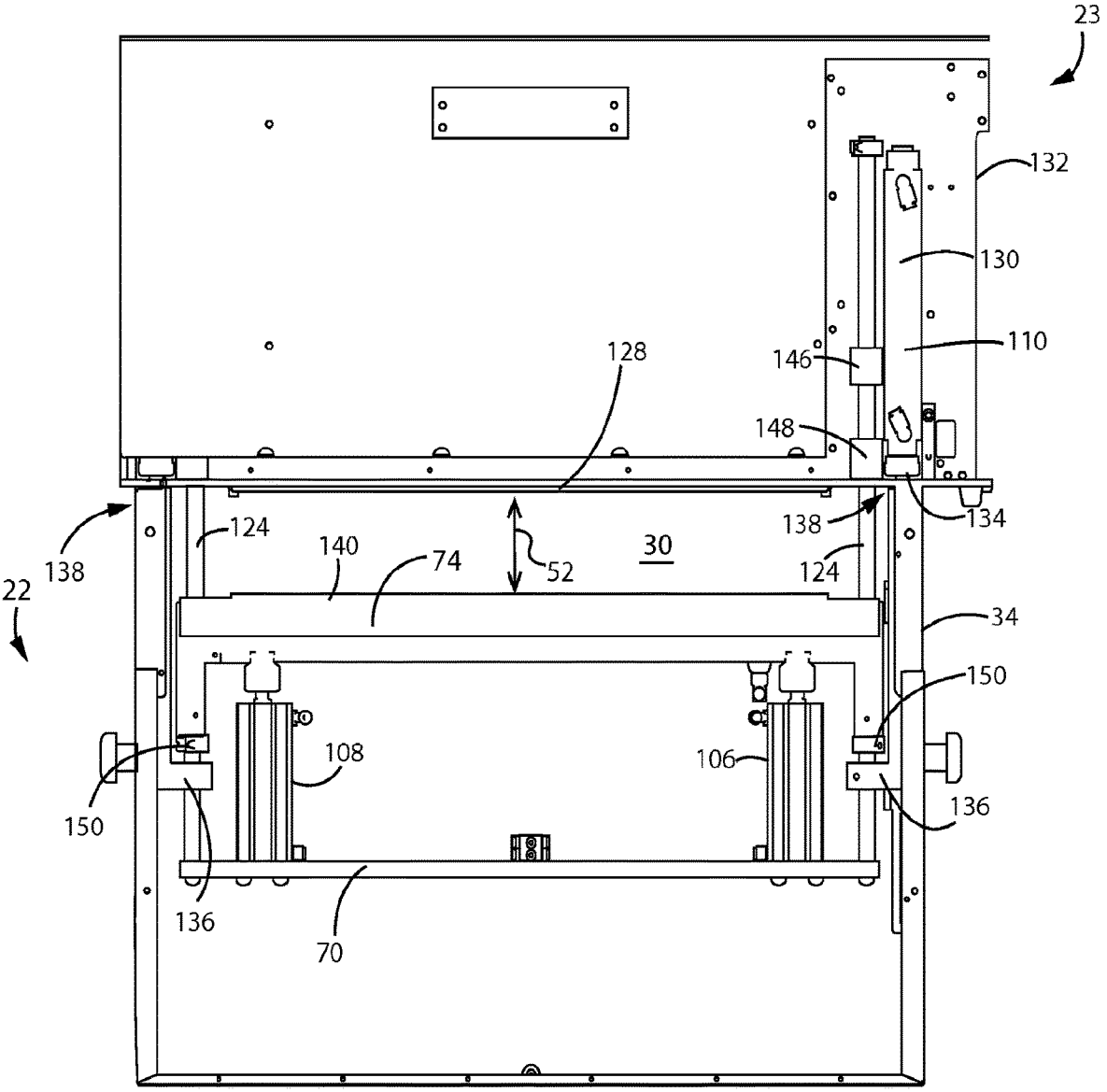
FIG. 11 is a view similar to FIG. 9 with the product bag packaging assembly in the first orientation shown in FIG. 6.

Referring to FIG. 11, when actuators 106, 108 and actuators 110, 112 are in a retracted orientations, the distance between seal 128 and face 140 of cross member 74 is approximately four inches such that actuation of only actuators 106, 108 between the extended and retracted positions provides a product pass through dimension of between approximately zero and approximately four inches. Said in another way, if smaller stroke sizes are desired for packaging of a given product, actuators 110, 112 can be maintained in a static or non-operational condition such that the packaging cycle is accommodated by the cyclic operation of only actuator 106, 108.

It should be appreciated that the various dimensions of approximately four, six, and ten inches associated with product pass through 30 provided above with respect to the extension and retraction or cyclic operation of actuators 106, 108, 110, 112 are merely exemplary and that other product pass through dimensions are envisioned. That is, it is appreciated that there are various methodologies associated with adjusting the stroke length and/or the available translation associated with operation of actuators 106, 108, 110, 112.

For instance, one or both of sets of actuators 106, 108 and 110, 112 could be replaced with actuators having other operating dimensions or stroke lengths. It is further appreciated that when provided as electric actuators, various operational stroke lengths can be defined by operational signals communicated to the respective actuators. As another alternatively, product bagging assembly 22 can include one or more spacers and/or variable length bumpers 146, 148 that could be associated with one or more of shafts 124 and/or the respective shafts associated with one or more of actuators 106, 108, 110, 112. It is further appreciated that one or more lock collars 150 could be associated with shafts 124 and/or the shafts associated with actuators 106, 108, 110, 112, to achieve the desired operating or stroke length and/or translation of cross member 74 and/or carriage 72 relative to product pass through 30. Alternatively, adjustable position limit switches may be implemented and connected to control system 32 to designate the desired operating stroke associated with operation of one or more of actuators 106, 108, 110, 112.

It is further appreciated that arm 136 could also be provided with an adjustment assembly 154, configured to manipulate the operating length associated with extension and retraction of the shaft associated with one or both of actuators 110, 112. It is further appreciated that the mounting arrangement associated with one or both of sets of actuators 106, 108, 110, 112 could be adjusted to manipulate the effective operating stroke associated with the respective set of actuators.

The exemplary adjustment methodologies disclosed above should not be considered exhaustive and/or mutually exclusive. That is, product bagging assembly 22 may include none, one, or multiple of the features discussed above to achieve the desired degree of adjustability associated with the desired or intended utilization product bagging assembly 22. That is, whereas some user may only consume one bag size or type and not desire or require some or any of the adjustability features disclosed above, more product dynamic users may desire one or more or comparable adjustability features to accommodate utilization of product bagging assembly 22 with various bag and product shapes and sizes within the operable range associate with product bagging assembly 22. Regardless of the adjustability methodology utilized, each allows product bagging assembly 22 to be quickly and conveniently configured for the desired operation associated with the use of product bagging assembly 22 with bags and products having different shapes and sizes.

It is further appreciated that many consumers may already have access to or own bag feeder/loader devices 23 configured to communicate web material bags to product bag loading assemblies similar to product bagging assembly 22. As such, it is envisioned that product bagging assembly 22 be provided as a kit constructed to cooperate with previously acquired bag feeder/loader assemblies 23. It is further appreciated that one or more of actuators 110, 112 may be included in such a kit or omitted if the previously acquired bag feeder/loader assembly includes a suitable actuator configured to interact with the previously acquired product bagging assembly.

Upon acquisition, connection of product bagging assembly 22 to the pre-acquired bag feeder/loader, and connection of the various actuators/operators to power or pneumatic systems associated with the underlying system and controller 32 allow product bagging assembly 22 to be quickly and conveniently configured to satisfy various user packaging demands and/or preferences. The adjustability and various operating states associated with use of product bagging assembly 22 allows a single bagging assembly to satisfy the various known and possible unknown demands or desires of various types of users, greater product size throughputs than previously available, and at product throughput rates that negligibly affect or improve product bagging process efficiency.

Although the present application discloses what is perceived to be the most practical and preferred embodiments, it is to be understood that the invention is not intended to be limited to the specific embodiments set forth above. It is recognized that modifications may be made by one of skill in the art of the invention without departing from the spirit or intent of the invention and, therefore, the invention is to be taken as including all reasonable equivalents to the subject matter of the appended claims and the description of the invention herein. The appending claims cover all such alternatives and equivalents.

What is claimed is:

1. A method for opening and closing a bag for packaging a product, comprising:

feeding a presented bag from a sequence of connected bags to a product-loading area of a bagging machine;

engaging a front-facing side of the presented bag with a bag-open assembly;

manipulating the position of a first actuator with respect to the product-loading area by operating a second actuator that is associated with the first actuator, the first actuator being associated with the bag-open assembly; and by simultaneous actuation, operating the first and second actuators cooperatively to:

pull the front-facing side of the presented bag away from an opposite side of the presented bag with the engaged bag-open assembly to position the front-facing side of the presented bag in an open configuration spaced from the opposite side of the presented bag to define a bag-loading opening between the front facing and opposite sides of the presented bag and to permit loading the product into the presented bag through the bag-loading opening, and move the front-facing side of the presented bag against the opposite side of the presented bag to close the bag-loading opening.

2. The method of claim 1, wherein the first and second actuators are operated such that:

extending the second actuator moves the first actuator away from the product-loading area; and retracting the second actuator moves the first actuator towards the product-loading area.

3. The method of claim 2, wherein operating the first and second actuators cooperatively to pull the front-facing side away from the product-loading area includes simultaneously extending the second actuator and retracting the first actuator.

4. The method of claim 2, wherein operating the first and second actuators cooperatively to move the front-facing side against the opposite side includes simultaneously contracting the second actuator and extending the first actuator.

5. The method of claim 1, further comprising, after closing the bag-loading opening, sealing the front-facing and opposite sides together.

6. The method of claim 5, wherein sealing the front-facing and opposite sides together includes heat-sealing the sides together.

7. The method of claim 5, wherein sealing the front-facing and opposite sides together includes operating the first and second actuators cooperatively to compress the front-facing and opposite sides against a sealing assembly.

8. The method of claim 7, wherein the sealing assembly includes a sealing element, the method further comprising selectively exposing the sealing element to be proximate the front-facing and opposite sides prior to sealing the sides together.

9. The method of claim 8, wherein the sealing element is extendable and retractable relative to the sealing assembly.

10. The method of claim 9, wherein the sealing element includes a pressure bar and/or heating element.

11. The method of claim 8, further comprising separating the presented bag with the sides sealed together from a subsequent bag in the sequence of connected bags with a cutting element disposed proximate the sealing assembly.

12. The method of claim 5, further comprising separating the presented bag with the sides sealed together from a subsequent bag in the sequence of connected bags.

13. The method of claim 12, wherein separating the presented bag from the subsequent bag includes separating the presented bag from the subsequent bag at a selectively tearable perforation feature between the presented bag and the subsequent bag.

14. The method of claim 12, wherein separating the presented bag from the subsequent bag includes separating the presented bag from the subsequent bag with a cutting element.

15. The method of claim 1, wherein engaging the front-facing side of the presented bag includes engaging the front-facing side with a suction or vacuum-assist device.

16. The method of claim 1, further comprising disposing the product in the presented bag prior to closing the bag-loading opening.

17. The method of claim 16, further comprising after closing the bag-loading opening, separating the presented bag from a subsequent bag in the sequence of connected bags.

18. The method of claim 1, wherein:

the bag-open assembly includes a plurality of bag opening devices that are spaced laterally from each other to define a width of the bag-loading opening; and the engaging and pulling of the front-facing side of the presented bag is conducted using the plurality of bag opening devices.

19. A method for packaging a product, comprising:

feeding a presented bag from a sequence of connected bags to a product-loading area of a bagging machine;

simultaneously actuating a first actuator and a second actuator to pull a front-facing side of the presented bag away from an opposite side of the presented bag to position the front-facing side of the presented bag spaced from the opposite side of the presented bag to define a bag-loading opening between the front facing and opposite sides of the presented bag and to permit loading the product into the presented bag through the bag-loading opening;

moving the front-facing side of the presented bag against the opposite side of the presented bag to close the bag-loading opening;

after closing the bag-loading opening, sealing the front-facing and opposite sides together; and after sealing the sides together, separating the presented bag from a subsequent bag in the sequence of connected bags.

* * * * *